US009347301B2

(12) United States Patent
Gao et al.

(10) Patent No.: US 9,347,301 B2
(45) Date of Patent: May 24, 2016

(54) PNEUMATIC FRACTURING METHOD AND SYSTEM FOR EXPLOITING SHALE GAS

(71) Applicant: SICHUAN UNIVERSITY, Chengdu (CN)

(72) Inventors: Feng Gao, Chengdu (CN); Heping Xie, Chengdu (CN); Fubao Zhou, Chengdu (CN); Yang Ju, Chengdu (CN); Lingzhi Xie, Chengdu (CN); Yingke Liu, Chengdu (CN); Yanan Gao, Chengdu (CN); Jianfeng Liu, Chengdu (CN); Ru Zhang, Chengdu (CN)

(73) Assignee: SICHUAN UNIVERSITY, Chengdu (CN)

( * ) Notice: Subject to any disclaimer, the term of this patent is extended or adjusted under 35 U.S.C. 154(b) by 18 days.

(21) Appl. No.: 14/335,935

(22) Filed: Jul. 20, 2014

(65) Prior Publication Data

US 2014/0326450 A1 Nov. 6, 2014

Related U.S. Application Data

(63) Continuation-in-part of application No. PCT/CN2013/077007, filed on Jun. 8, 2013.

(30) Foreign Application Priority Data

Jun. 8, 2012 (CN) ..... 2012 1 0188794

(51) Int. Cl.
*E21B 43/247* (2006.01)
*E21B 43/26* (2006.01)
*E21B 43/16* (2006.01)

(52) U.S. Cl.
CPC ..... *E21B 43/168* (2013.01); *E21B 43/26* (2013.01); *E21B 43/247* (2013.01)

(58) Field of Classification Search
CPC ... E21B 43/247; E21B 43/24; E21B 43/2401; E21B 43/243; E21B 43/30; E21B 43/26; E21B 43/168
See application file for complete search history.

(56) References Cited

U.S. PATENT DOCUMENTS

2014/0008074 A1* 1/2014 Nevison ..... E21B 43/26 166/308.6

* cited by examiner

*Primary Examiner* — Zakiya W Bates
(74) *Attorney, Agent, or Firm* — Matthias Scholl, PC; Matthias Scholl

(57) ABSTRACT

A pneumatic fracturing method for exploiting shale gas, the method including: 1) applying a compressed gas for a first period of time at a first pressure to a shale formation; 2) applying the compressed gas for a second period of time at a second pressure to the shale formation; and 3) repeating steps 1) and 2) to produce fissures in the shale formation. A temperature of the compressed gas is at least 80° C. A maximum pressure of the compressed gas is at least 25 megapascal, and a minimum pressure of the compressed gas is between ¼ and ⅓ of the maximum pressure.

9 Claims, 16 Drawing Sheets

PNEUMATIC FRACTURING METHOD AND SYSTEM FOR EXPLOITING SHALE GAS

CROSS-REFERENCE TO RELATED APPLICATIONS

This application is a continuation-in-part of International Patent Application No. PCT/CN2013/077007 with an international filing date of Jun. 8, 2013, designating the United States, now pending, and further claims priority benefits to Chinese Patent Application No. 201210188794.X filed Jun. 8, 2012. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

1. Field of the Invention

The invention relates to the field of shale gas exploitation, and more particularly to a pneumatic fracturing method and a system for exploiting shale gas.

2. Description of the Related Art

A typical method for exploiting the shale gas and oil resource generally adopts the hydraulic fracturing technology, which includes: pressing a fracturing fluid into an oil well, fracturing a rock formation to produce fissure channels having high flow conductivity, and injecting a proppant (mainly quartz sand) to support factures, thereby further improving the oil-gas recovery factor. As the fracturing fluid used in the exploitation of the shale gas includes 98 wt. % of water and 2 wt. % of chemical additives, problems as follows occur:

1) The water consumption is tremendous, so that the hydraulic fracturing technology is not applicable to water shortage or water deficit areas where the shale gas distributes.

2) Although the hydraulic fracturing has a high fracturing pressure, with a maximum of 140 megapascal. However, main cracks forming under the action of the hydraulic fracturing has a limited number and the form thereof is single, which result in a low degree of fracturing of the shale formation. Besides, as the fluid has a large surface tension and molecules and poor permeability, it is difficult to introduce the fluid into the compact fissures in the shale formation or to improve the permeability of oil-gas in the shale formation, thereby resulting in low recovery factor.

3) The chemical additives and the shale gas (mainly methane) in the fracturing fluid enter the ground water, seriously pollute the ecological environment, and seriously restrict the exploitation of the shale gas.

SUMMARY OF THE INVENTION

In view of the above-described problems, it is one objective of the invention to provide a pneumatic fracturing method and a system for exploiting shale gas for facilitating the shale gas exploitation in water shortage or deficit areas, improving recovery factor of the shale gas, and protecting the ecological environment.

To achieve the above objective, in accordance with one embodiment of the invention, there is provided a pneumatic fracturing method for exploiting shale gas. The method comprises: 1) applying a compressed gas for a first period of time at a first pressure to a shale formation; 2) applying the compressed gas for a second period of time at a second pressure to the shale formation; and 3) repeating steps 1) and 2) to produce fissures in the shale formation. A temperature of the compressed gas is at least 80° C., a maximum pressure of the compressed gas is at least 25 megapascal, and a minimum pressure of the compressed gas is between ¼ and ⅓ of the maximum pressure. The fissures mean that the shale formation cracks and tight micro pores in the shale formation communicate with each other, thereby possessing conditions for exploiting the shale gas.

In a class of this embodiment, the compressed gas is compressed air or compressed carbon dioxide. When the compressed air is adopted, a temperature thereof is at least 150° C., and a maximum pressure thereof is at least 45 megapascal. In order to improve the fracture effect of the shale formation, a water content of the compressed air is preferably controlled between 10 and 50 volume %. When the compressed carbon dioxide is adopted, a temperature thereof is at least 80° C. and a maximum pressure thereof is at least 25 megapascal.

In a class of this embodiment, the method specifically comprises the following steps:

A) drilling a vertical well and a horizontal well communicating with the vertical well in the shale formation, and installing a gas transporting pipeline having insulation property in the vertical well and the horizontal well; wherein an outer diameter of the gas transporting pipeline is smaller than an inner diameter of the vertical well and an inner diameter of the horizontal well; ventholes are arranged on a wall of the gas transporting pipeline installed in the horizontal well; and an annular space forms between an inner surface of the horizontal well and an outer surface of the gas transporting pipeline, and annular occluders are arranged in the annular space at an interval of between 30 and 50 m to form a plurality of annular gas chambers;

B) injecting the compressed gas satisfying the maximum pressure to the gas transporting pipeline, and maintaining the pressure for between 0.5 and 1 hr, and decreasing the pressure in the gas transporting pipeline to satisfy the minimum pressure after the holding time, whereby allowing the compressed gas of the maximum pressure and the compressed gas of the minimum pressure to alternately fill the annular gas chambers and act on the shale formation; and C) repeating step B) for several times to produce fissures in the shale formation.

In accordance with another embodiment of the invention, there is provided a first pneumatic fracturing system for exploiting shale gas. The system comprises: a compressor; a booster; a pressure control system, the pressure control system comprising a pressure controller, a first control valve, and a second control valve; and a gas transporting pipeline, the gas transporting pipeline comprising a gas inlet pipe and a gas outlet pipe. The first control valve is disposed on the gas inlet pipe of the gas transporting pipeline. The second control valve is disposed on the gas outlet pipe of the gas transporting pipeline. A gas outlet of the compressor communicates with a gas inlet of the booster via a pipe fitting. A gas outlet of the booster communicates with a gas inlet of the first control valve via a pipe fitting. The pressure controller is connected to the compressor, the booster, the first control valve, and the second control valve via data lines for controlling formation of the compressed gas and alternative variation and holding of the pressure in the gas transporting pipeline. The pneumatic fracturing system of such structure is applicable to conditions that the temperature in the process of compressing the gas is capable of allowing the compressed gas to reach the required high temperature.

In accordance with another embodiment of the invention, there is provided a second pneumatic fracturing system for exploiting shale gas. The system comprises: a compressor; a booster; a heater; a pressure control system, the pressure control system comprising a pressure controller, a first control valve, and a second control valve; and a gas transporting pipeline, the gas transporting pipeline comprising a gas inlet pipe and a gas outlet pipe. The first control valve is disposed on the gas inlet pipe of the gas transporting pipeline. The second control valve is disposed on the gas outlet pipe of the gas transporting pipeline. A gas outlet of the compressor communicates with a gas inlet of the booster via a pipe fitting. A gas outlet of the booster communicates with a gas inlet of the heater via a pipe fitting. A gas outlet of the heater communicates with a gas inlet of the first control valve via a pipe fitting. The pressure controller is connected to the compressor, the booster, the heater, the first control valve, and the second control valve via data lines for controlling formation of the compressed gas and alternative variation and holding of the pressure in the gas transporting pipeline. The pneumatic fracturing system of such structure is applicable to conditions that the temperature produced in the process of compressing the gas is incapable of allowing the compressed gas to reach the required high temperature.

In a class of this embodiment, the system further comprises: a dehumidifier. A gas inlet of the dehumidifier communicates with a gas outlet of the compressor via a pipe fitting. A gas outlet of the dehumidifier communicates with a gas inlet of the booster via a pipe fitting. The dehumidifier is connected to the pressure controller via a data line.

In a class of this embodiment, the pressure controller is a computer installed with a control software. Under the control of the pressure controller, an atmospheric gas is preliminarily compressed by the compressor to between 1 and 10 megapascal. The water content of the compressed gas from the compressor is decreased by the dehumidifier until a required water content is satisfied. The compressed gas from the compressor or the compressed gas from the dehumidifier is pressurized by the booster to allow the compressed gas to satisfy the maximum pressure. If the temperature of the compressed gas after pressurization by the booster is lower than the required temperature, the heater is used to heat the compressed gas from the booster to make the compressed gas meet the required temperature. Under the control of the pressure controller, the first control valve is open or close, and the second control valve is open or close. The first control valve is used to inject the compressed gas satisfying the maximum pressure into the gas transporting pipeline installed in the vertical well and the horizontal well drilled in the shale formation. The second control valve is used to exhaust the gas and to decrease the gas pressure in the gas transporting pipeline.

Advantages according to embodiments of the invention are summarized as follows:

1. The method of the invention provides a technical solution different from the prior art in the exploitation of the shale gas. Not only is the problem solved that the shale gas is unable to be exploited in water shortage or deficit areas, but also it is beneficial for the protection of the ecological environment.

2. As the method of the invention utilizes the high temperature and high pressure gases to make brittle fatigue failures occur in the shale formation under the action of alternative different pressures thereby resulting in fissures, thus, the tight micro pores in the shale formation grow and communicate with each other. The permeability of the shale formation is largely improved, the desorption of the shale gas is facilitated, activities of oil and gas molecules are enhanced, that is, the filtration and the dissipation capacity of the oil and gas molecules are increased, thereby increasing the recovery efficiency of the shale gas.

3. The system of the invention is capable of conducting multi-stage gas compression and using multi sets in parallel to extract the shale gas, thereby ensuring the fracturing pressure and the thermal energy of the gas.

4. The system of the invention is capable of controlling the aptitude and frequency of the compressed gas to continuously enlarge the fissures in the shale formation and widespread the fissures to deep regions, thereby broadening the channel and the range of the eruption of the shale oil and gas.

BRIEF DESCRIPTION OF THE DRAWINGS

The invention is described hereinbelow with reference to the accompanying drawings, in which.

Figure 1:
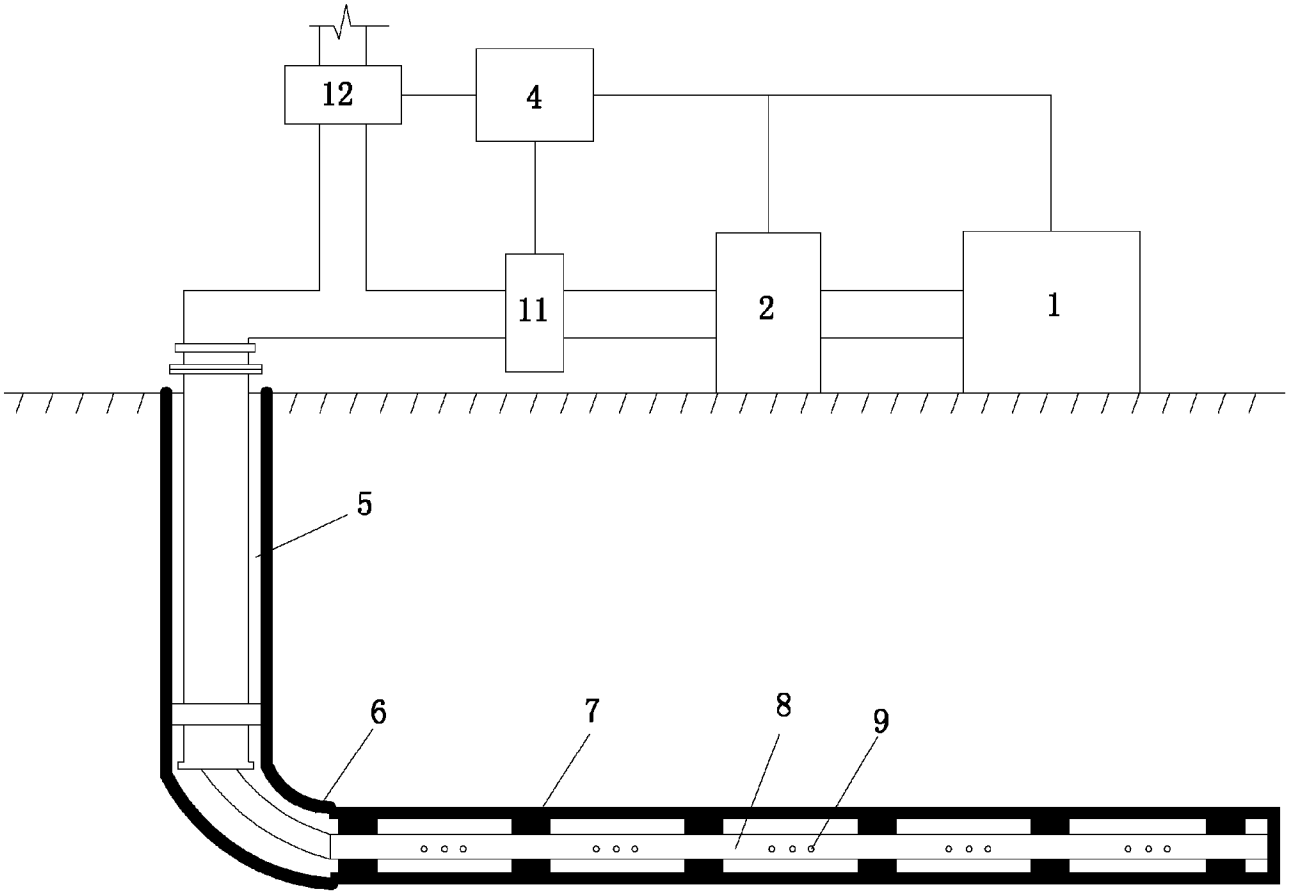
FIG. 1 is a first layout diagram of a pneumatic fracturing system for exploiting shale gas in accordance with one embodiment of the invention.

In the drawings, the following reference numbers are used: 1. Compressor; 2. Booster; 3. Heater; 4. Pressure controller; 5. Vertical well; 6. Horizontal well; 7. Occluder; 8. Gas transporting pipeline; 9. Venthole; 10. Dehumidifier; 11. First control valve; 12. Second control valve; and 13. Shale fissure.

DETAILED DESCRIPTION OF THE EMBODIMENTS

For further illustrating the invention, experiments detailing a pneumatic fracturing method and a system for exploiting shale gas are described below. It should be noted that the following examples are intended to describe and not to limit the invention.

A compressor herein employs a SF-10/250 gas compressor (air compressor) or a VW-16.7/40 (carbon dioxide compressor) manufactured by Bengbu Aipu Compressor Plant, China. A booster employs an ST140-7.5GH booster manufactured by Jinan Shineeast Fluid System Device Co. LTD. A heater employs a QL-GD-685 gas heater manufactured by Qili Power Equipment Co. LTD. A dehumidifier employs an HZXW regenerative adsorption dryer manufactured by Hanzheng Gas Source Equipment Co. LTD. Both a first control valve and a second control valve employ PO high pressure pneumatic ball valves manufactured by POLOVO. A pressure controller is an industrial computer installed with a control software.

Example 1

A pneumatic fracturing system is shown in FIG. 1, and a pneumatic fracturing method for exploiting shale gas using the system employs compressed air of two different pressures to alternately act on a shale formation. The method is conducted as follows:

A) A vertical well 5 and a horizontal well 6 communicating with the vertical well 5 are drilled in the shale formation, and a gas transporting pipeline 8 having insulation property is installed in the vertical well 5 and the horizontal well 6. An outer diameter of the gas transporting pipeline 8 is smaller than an inner diameter of the vertical well 5 and an inner diameter of the horizontal well 6. Ventholes 9 are arranged on a wall of the gas transporting pipeline 8 installed in the horizontal well 6. An annular space forms between an inner surface of the horizontal well 6 and an outer surface of the gas transporting pipeline 8, and annular occluders 7 are arranged in the annular space at an interval of 30 m to form a plurality of annular gas chambers.

The pneumatic fracturing system for exploiting shale gas comprises: a compressor 1, a booster 2, and a pressure control system. The pressure control system comprises: a pressure controller 4, a first control valve 11, and a second control valve 12. The first control valve 11 is disposed on a gas inlet pipe of the gas transporting pipeline 8. The second control valve 12 is disposed on a gas outlet pipe of the gas transporting pipeline 8. A gas outlet of the compressor 1 communicates with a gas inlet of the booster 2 via a pipe fitting. A gas outlet of the booster 2 communicates with a gas inlet of the first control valve 11 via a pipe fitting. The pressure controller 4 is connected to the compressor 1, the booster 2, the first control valve 11, and the second control valve 12 via data lines.

B) The pressure controller 4 is operated, and the compressor 1 and the booster 2 are started to enable the first control valve 11 to be in an open sate. The compressor 1 preliminarily compresses normal pressure air to reach a pressure of 5 megapascal. The booster 2 further pressurizes the compressed air from the compressor 1 to form compressed air having a temperature of exceeding 150° C. and a pressure of 45 megapascal, the pressure of which reaches the maximum pressure set in this example. The compressed air of the maximum pressure is injected into the gas transporting pipe 8 through the first control valve 11 and the maximum pressure is maintained for 0.5 hr. After the holding time, the first control valve 11 is closed and the second valve 12 is opened under the control of the pressure controller 4 to decrease the air pressure in the gas transporting pipe 8 to 15 megapascal, which is the minimum pressure set in this example. Thus, the compressed air of 45 megapascal and the compressed air of 15 megapascal alternately fill each annular gas chamber and act on the shale formation.

Figure 2:
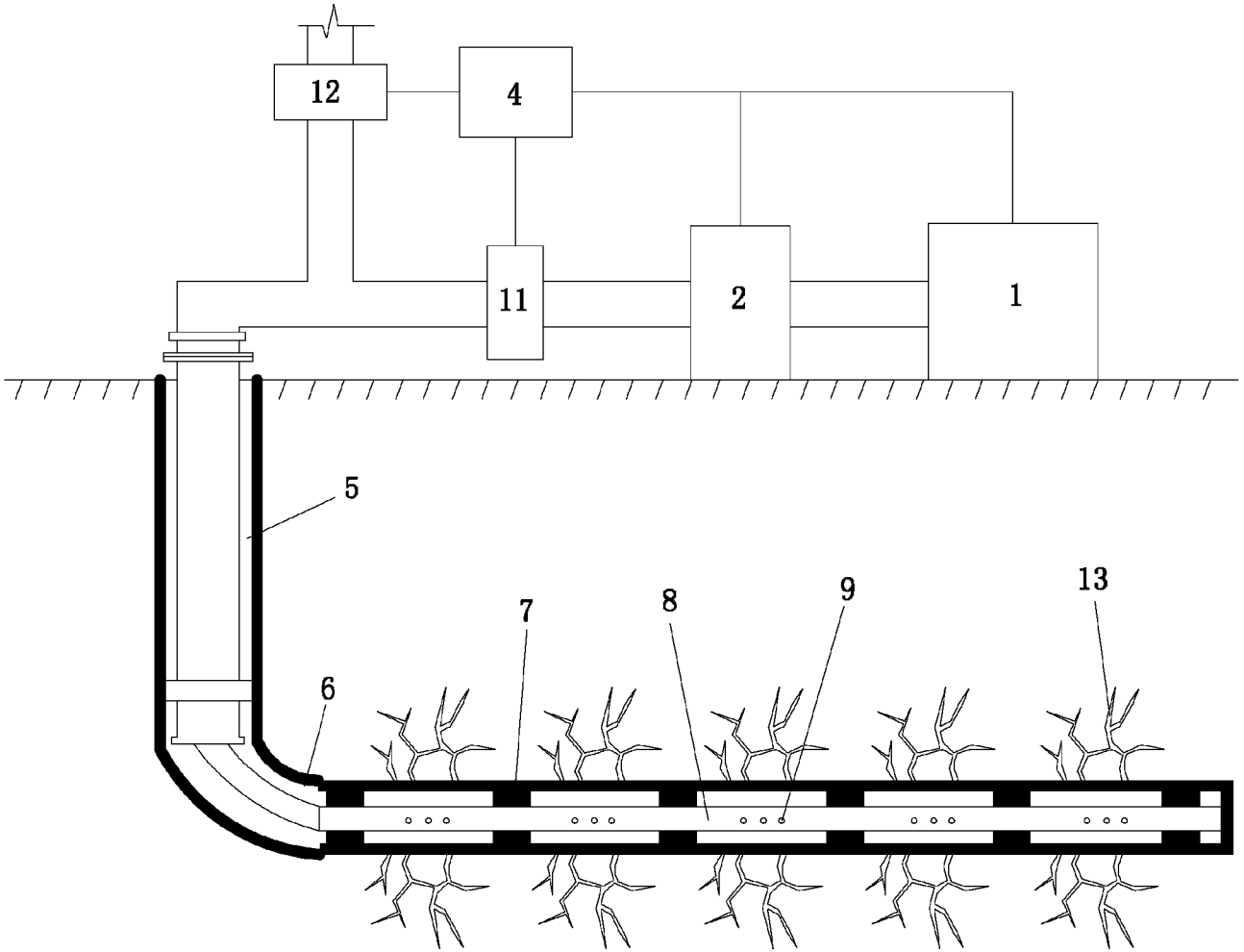
FIG. 2 is a structure diagram of fissures formed in a shale formation using a first system layout of FIG. 1.

C) Operations of step B) is repeated for 7 days under the control of the pressure controller 4. And fissures formed in the shale formation surrounding the horizontal well 6 are shown in FIG. 2.

Example 2

Figure 3:
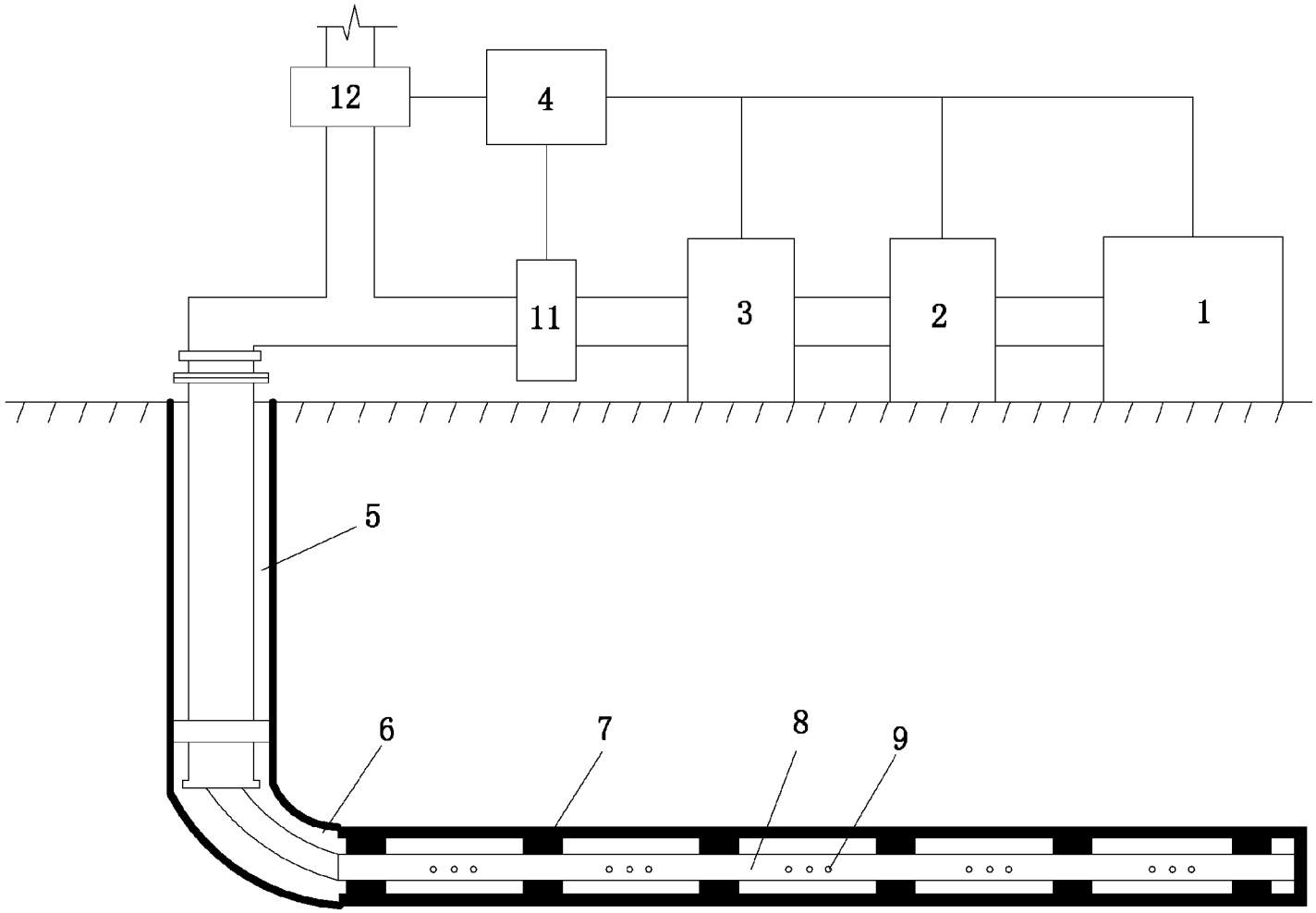
FIG. 3 is a second layout diagram of a pneumatic fracturing system for exploiting shale gas in accordance with one embodiment of the invention.

A pneumatic fracturing system is shown in FIG. 3, and a pneumatic fracturing method for exploiting shale gas using the system employs compressed carbon dioxide of two different pressures to alternately act on a shale formation. The method is conducted as follows:

A) A vertical well 5 and a horizontal well 6 communicating with the vertical well 5 are drilled in the shale formation, and a gas transporting pipeline 8 having insulation property is installed in the vertical well 5 and the horizontal well 6. An outer diameter of the gas transporting pipeline 8 is smaller than an inner diameter of the vertical well 5 and an inner diameter of the horizontal well 6. Ventholes 9 are arranged on a wall of the gas transporting pipeline 8 installed in the horizontal well 6. An annular space forms between an inner surface of the horizontal well 6 and an outer surface of the gas transporting pipeline 8, and annular occluders 7 are arranged in the annular space at an interval of 40 m to form a plurality of annular gas chambers.

The pneumatic fracturing system for exploiting shale gas comprises: a compressor 1, a booster 2, a heater 3, and a pressure control system. The pressure control system comprises: a pressure controller 4, a first control valve 11, and a second control valve 12. The first control valve 11 is disposed on a gas inlet pipe of the gas transporting pipeline 8. The second control valve 12 is disposed on a gas outlet pipe of the gas transporting pipeline 8. A gas outlet of the compressor 1 communicates with a gas inlet of the booster 2 via a pipe fitting. A gas outlet of the booster 2 communicates with a gas inlet of the heater 3 via a pipe fitting. A gas outlet of the heater 3 communicates with a gas inlet of the first control valve 11 via a pipe fitting. The pressure controller 4 is connected to the compressor 1, the booster 2, the heater 3, the first control valve 11, and the second control valve 12 via data lines.

B) The pressure controller 4 is operated, and the compressor 1, the booster 2, and the heater 3 are started to enable the first control valve 11 to be in an open sate. The compressor 1 preliminarily compresses normal pressure carbon dioxide to reach a pressure of 2 megapascal; the booster 2 pressurizes the compressed carbon dioxide from the compressor 1 to reach a pressure of 25 megapascal; and the heater 3 heat the pressurized carbon dioxide to a temperature of 100° C. to yield the compressed carbon dioxide of a maximum pressure set in this example. The compressed carbon dioxide of the maximum pressure is injected into the gas transporting pipe 8 through the first control valve 11 and the maximum pressure is maintained for 1 hr. After the holding time, the first control valve 11 is closed and the second valve 12 is opened under the control of the pressure controller 4 to decrease the gas pressure in the gas transporting pipe 8 to 8 megapascal, which is the minimum pressure set in this example. Thus, the compressed carbon dioxide of 25 megapascal and the compressed carbon dioxide of 8 megapascal alternately fill each annular gas chamber and act on the shale formation.

Figure 4:
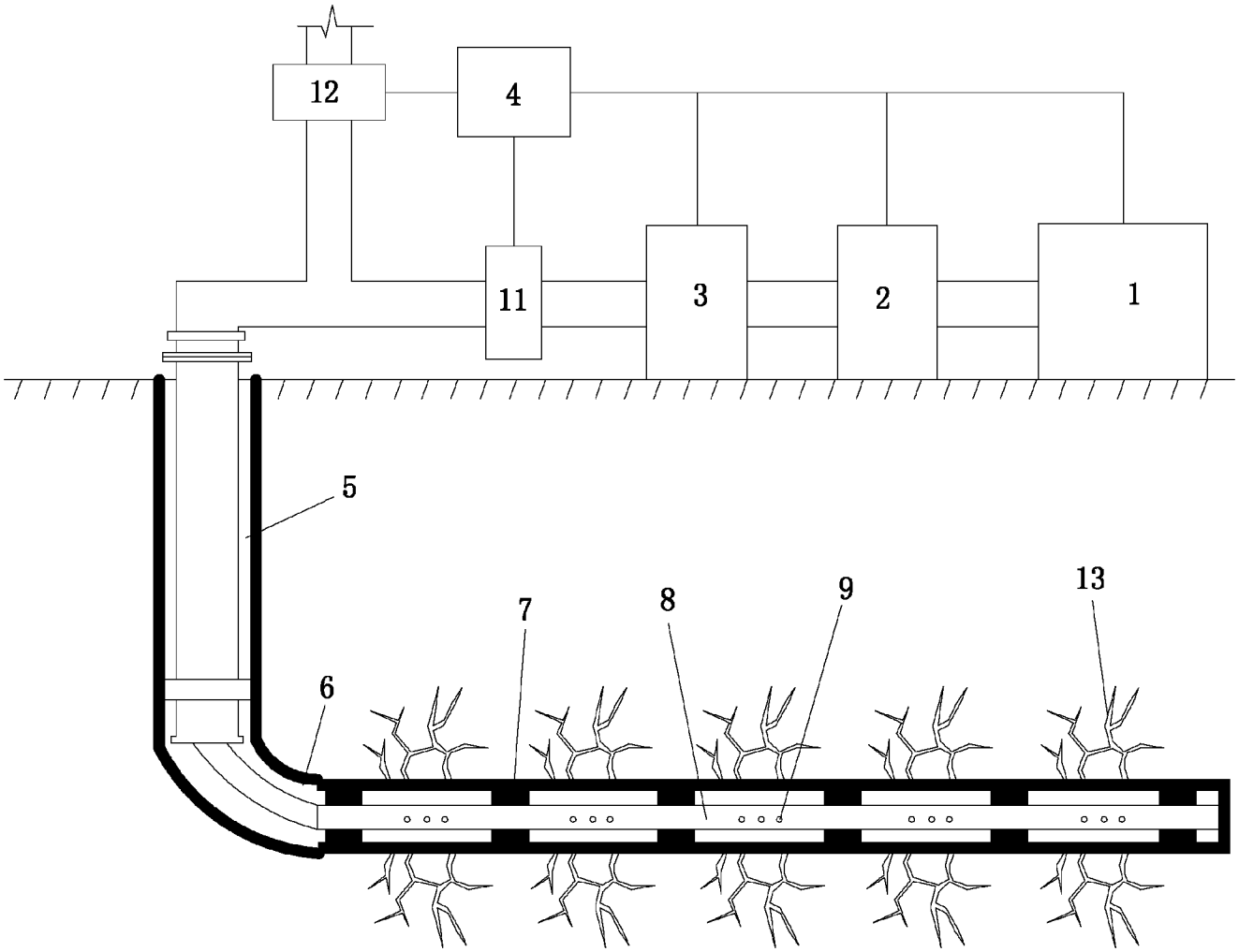
FIG. 4 is a structure diagram of fissures formed in a shale formation using a second system layout of FIG. 3.

C) Operations of step B) is repeated for 10 days under the control of the pressure controller 4. And fissures formed in the shale formation surrounding the horizontal well 6 are shown in FIG. 4.

Example 3

Figure 5:
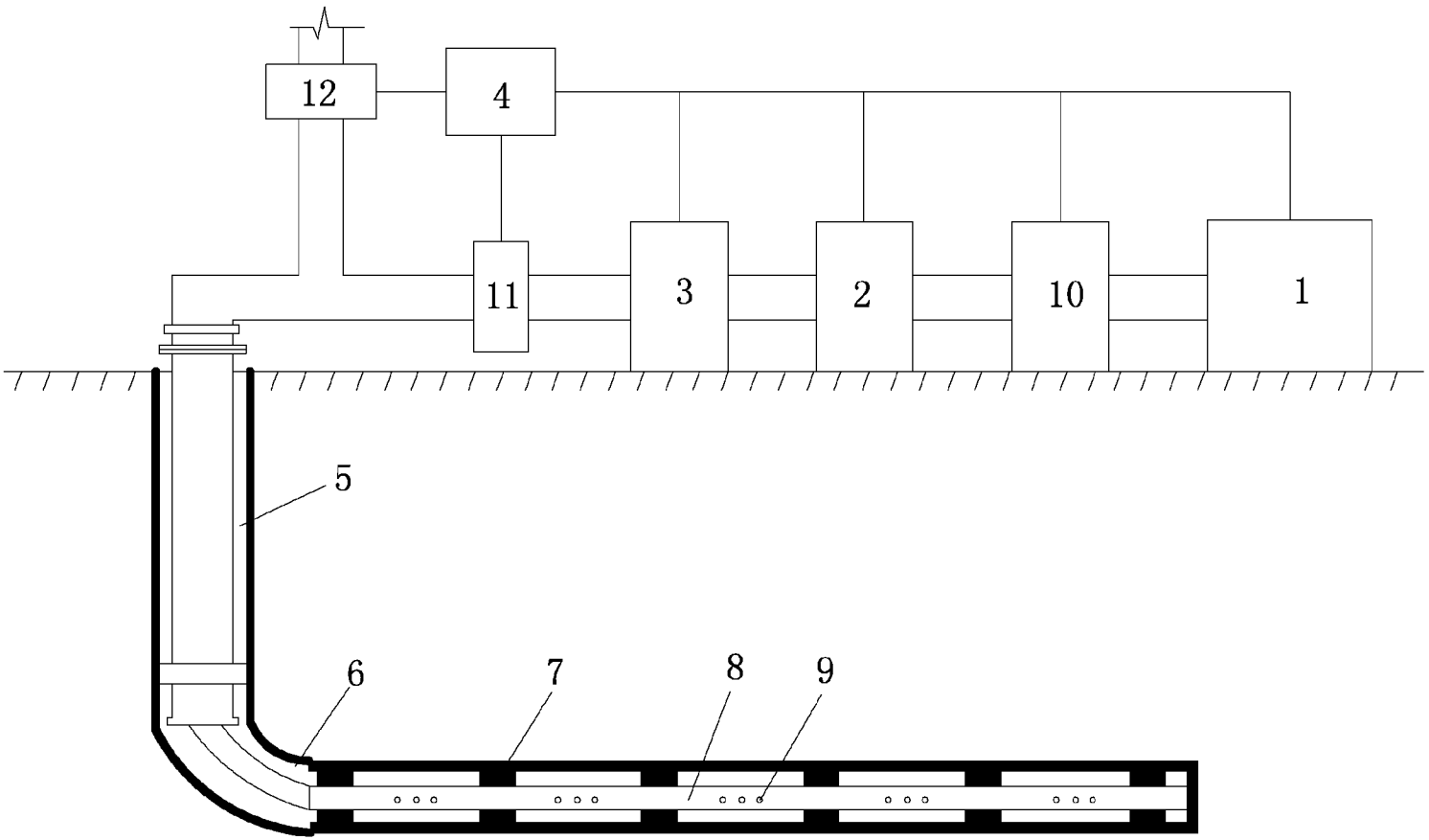
FIG. 5 is a third layout diagram of a pneumatic fracturing system for exploiting shale gas in accordance with one embodiment of the invention.

A pneumatic fracturing system is shown in FIG. 5, and a pneumatic fracturing method for exploiting shale gas using the system employs compressed air of two different pressures to alternately act on a shale formation. The method is conducted as follows:

A) A vertical well 5 and a horizontal well 6 communicating with the vertical well 5 are drilled in the shale formation, and a gas transporting pipeline 8 having insulation property is installed in the vertical well 5 and the horizontal well 6. An outer diameter of the gas transporting pipeline 8 is smaller than an inner diameter of the vertical well 5 and an inner diameter of the horizontal well 6. Ventholes 9 are arranged on a wall of the gas transporting pipeline 8 installed in the horizontal well 6. An annular space forms between an inner surface of the horizontal well 6 and an outer surface of the gas transporting pipeline 8, and annular occluders 7 are arranged in the annular space at an interval of 50 m to form a plurality of annular gas chambers.

The pneumatic fracturing system for exploiting shale gas comprises: a compressor 1, a booster 2, a heater 3, dehumidifier 10, and a pressure control system. The pressure control system comprises: a pressure controller 4, a first control valve 11, and a second control valve 12. The first control valve 11 is disposed on a gas inlet pipe of the gas transporting pipeline 8. The second control valve 12 is disposed on a gas outlet pipe of the gas transporting pipeline 8. A gas outlet of the compressor 1 communicates with a gas inlet of the dehumidifier 10 via a pipe fitting. A gas outlet of the dehumidifier 10 communicates with a gas inlet of the booster 2 a pipe fitting. A gas outlet of the booster 2 communicates with a gas inlet of a heater 3 via a pipe fitting. A gas outlet of the heater 3 communicates with a gas inlet of the first control valve 11 via a pipe fitting. The pressure controller 4 is connected to the compressor 1, the booster 2, the heater 3, the first control valve 11, and the second control valve 12 via data lines.

B) The pressure controller 4 is operated, and the compressor 1, the dehumidifier 10, the booster 2, and the heater 3 are started to enable the first control valve 11 to be in an open sate. The compressor 1 preliminarily compresses normal pressure air to reach a pressure of 1 megapascal; the dehumidifier 10 decreases a water content of the compressed air from the compressor 1 to 10 volume %; the booster 2 pressurizes the compressed air from the dehumidifier 10 to reach a pressure of 50 megapascal; and the heater 3 heats the pressurized air from the booster 2 to a temperature of 180° C. to yield the compressed air of a maximum pressure set in this example. The compressed air of the maximum pressure is injected into the gas transporting pipe 8 through the first control valve 11 and the maximum pressure is maintained for 1 hr. After the holding time, the first control valve 11 is closed and the second valve 12 is opened under the control of the pressure controller 4 to decrease the air pressure in the gas transporting pipe 8 to 14 megapascal, which is the minimum pressure set in this example. Thus, the compressed air of 50 megapascal and the compressed air of 14 megapascal alternately fill each annular gas chamber and act on the shale formation.

Figure 6:
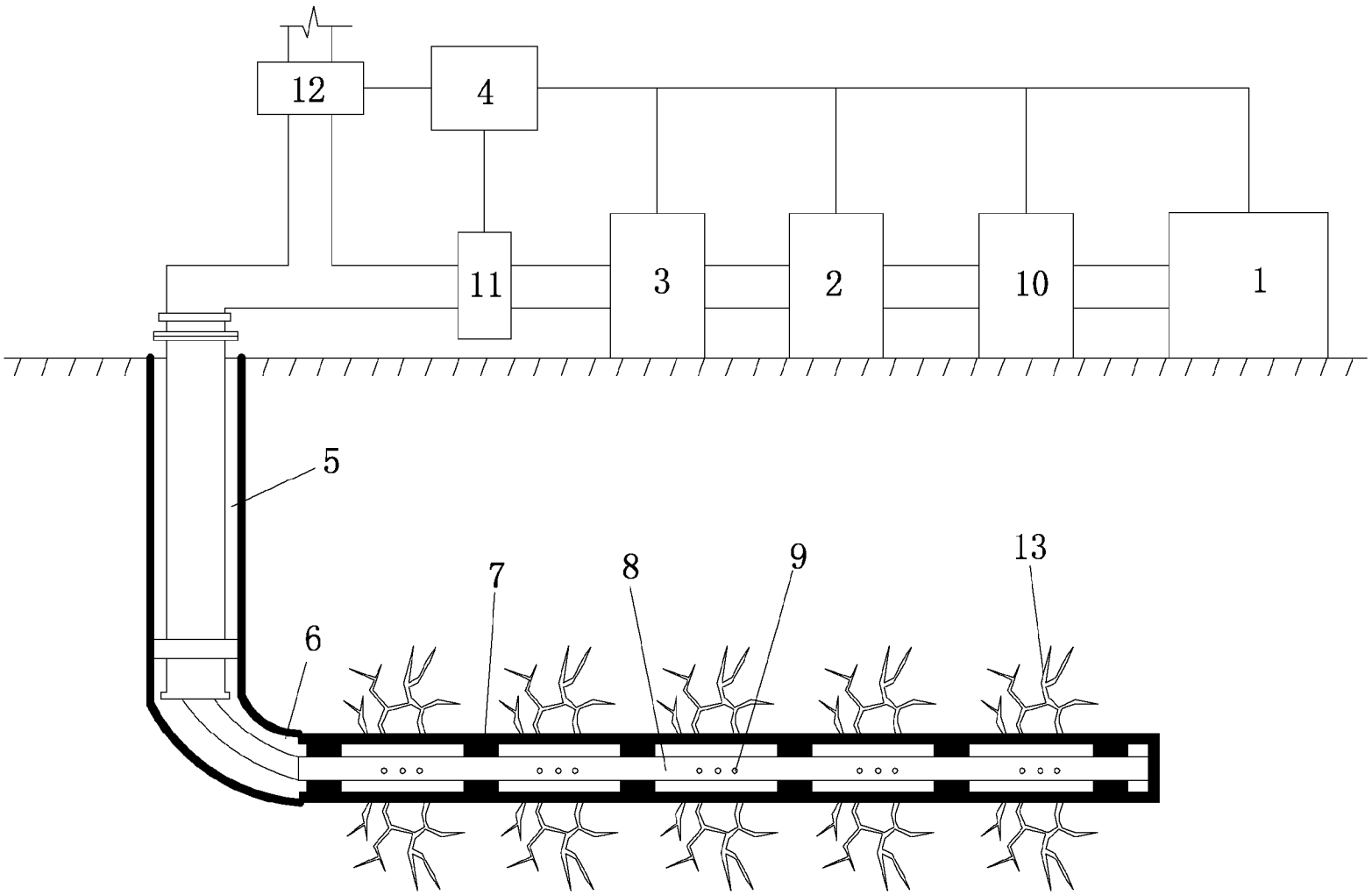
FIG. 6 is a structure diagram of fissures formed in a shale formation using a third system layout of FIG. 5.

C) Operations of step B) is repeated for 8 days under the control of the pressure controller 4. And fissures formed in the shale formation surrounding the horizontal well 6 are shown in FIG. 6.

Example 4

Figure 7:
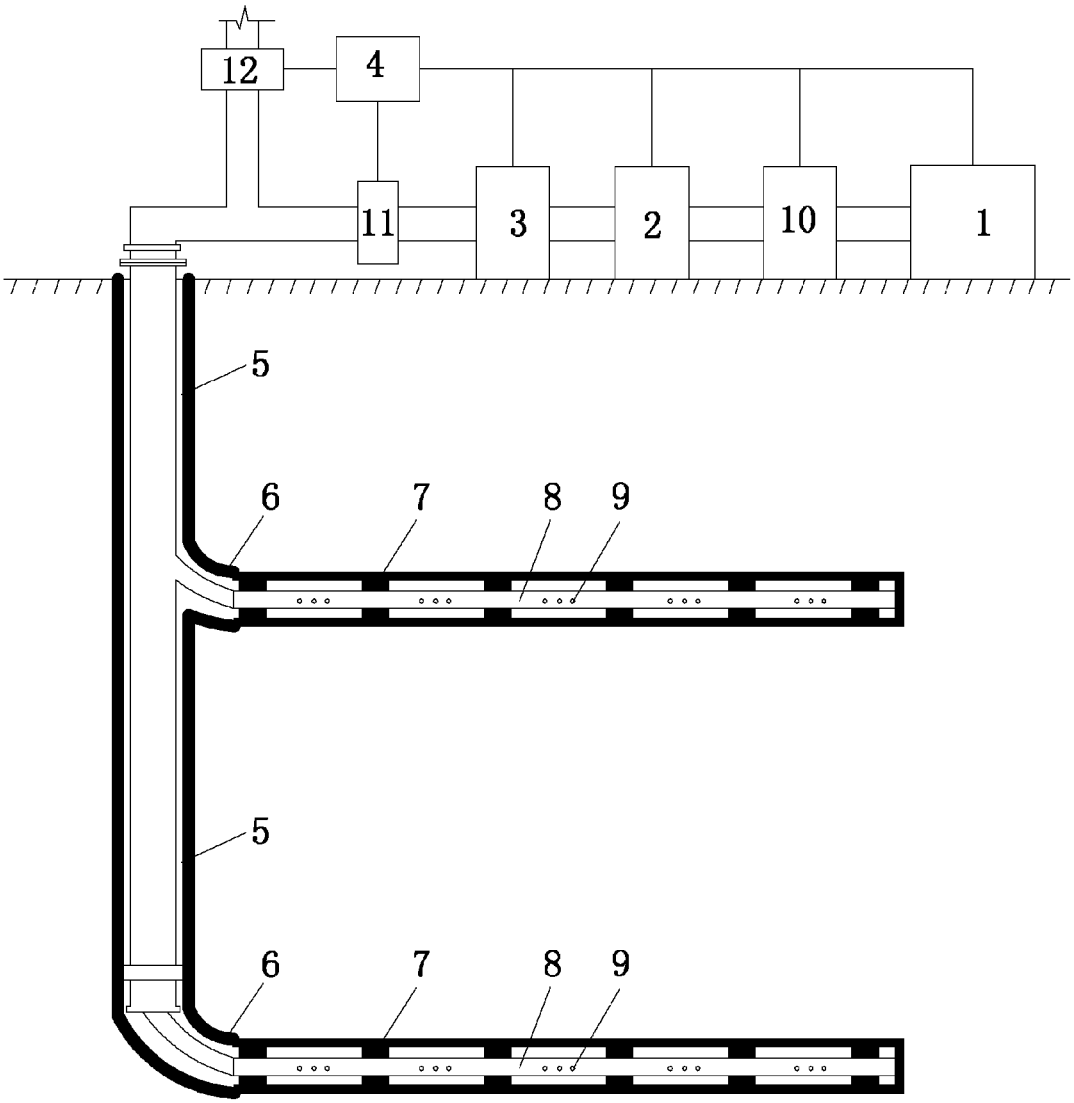
FIG. 7 is a fourth layout diagram of a pneumatic fracturing system for exploiting shale gas in accordance with one embodiment of the invention.

A pneumatic fracturing system is shown in FIG. 7, and a pneumatic fracturing method for exploiting shale gas using the system employs compressed air of two different pressures to alternately act on a shale formation. The method is conducted as follows:

A) A vertical well 5 and two horizontal wells 6 are drilled in the shale formation. The two horizontal wells 6 communicate with the vertical well 5 and are arranged at a certain interval on the same side of the vertical well 5. A gas transporting pipeline 8 having insulation property is installed in the vertical well 5 and the horizontal wells 6. An outer diameter of the gas transporting pipeline 8 is smaller than an inner diameter of the vertical well 5 and an inner diameter of each horizontal well 6. Ventholes 9 are arranged on a wall of the gas transporting pipeline 8 installed in each of the two horizontal well 6. An annular space forms between an inner surface of the horizontal well 6 and an outer surface of the gas transporting pipeline 8, and annular occluders 7 are arranged in the annular space at an interval of 30 m to form a plurality of annular gas chambers.

The pneumatic fracturing system for exploiting shale gas comprises: a compressor 1, a booster 2, a heater 3, dehumidifier 10, and a pressure control system. The pressure control system comprises: a pressure controller 4, a first control valve 11, and a second control valve 12. The first control valve 11 is disposed on a gas inlet pipe of the gas transporting pipeline 8. The second control valve 12 is disposed on a gas outlet pipe of the gas transporting pipeline 8. A gas outlet of the compressor 1 communicates with a gas inlet of the dehumidifier 10 via a pipe fitting. A gas outlet of the dehumidifier 10 communicates with a gas inlet of the booster 2 a pipe fitting. A gas outlet of the booster 2 communicates with a gas inlet of a heater 3 via a pipe fitting. A gas outlet of the heater 3 communicates with a gas inlet of the first control valve 11 via a pipe fitting. The pressure controller 4 is connected to the compressor 1, the booster 2, the heater 3, the first control valve 11, and the second control valve 12 via data lines.

B) The pressure controller 4 is operated, and the compressor 1, the dehumidifier 10, the booster 2, and the heater 3 are started to enable the first control valve 11 to be in an open sate. The compressor 1 preliminarily compresses normal pressure air to reach a pressure of 1 megapascal; the dehumidifier 10 decreases a water content of the compressed air from the compressor 1 to 50 volume %; the booster 2 pressurizes the compressed air from the dehumidifier 10 to reach a pressure of 45 megapascal; and the heater 3 heats the pressurized air from the booster 2 to a temperature of 180° C. to yield the compressed air of a maximum pressure set in this example. The compressed air of the maximum pressure is injected into the gas transporting pipe 8 through the first control valve 11 and the maximum pressure is maintained for 0.5 hr. After the holding time, the first control valve 11 is closed and the second valve 12 is opened under the control of the pressure controller 4 to decrease the air pressure in the gas transporting pipe 8 to 15 megapascal, which is the minimum pressure set in this example. Thus, the compressed air of 45 megapascal and the compressed air of 15 megapascal alternately fill each annular gas chamber and act on the shale formation.

Figure 8:
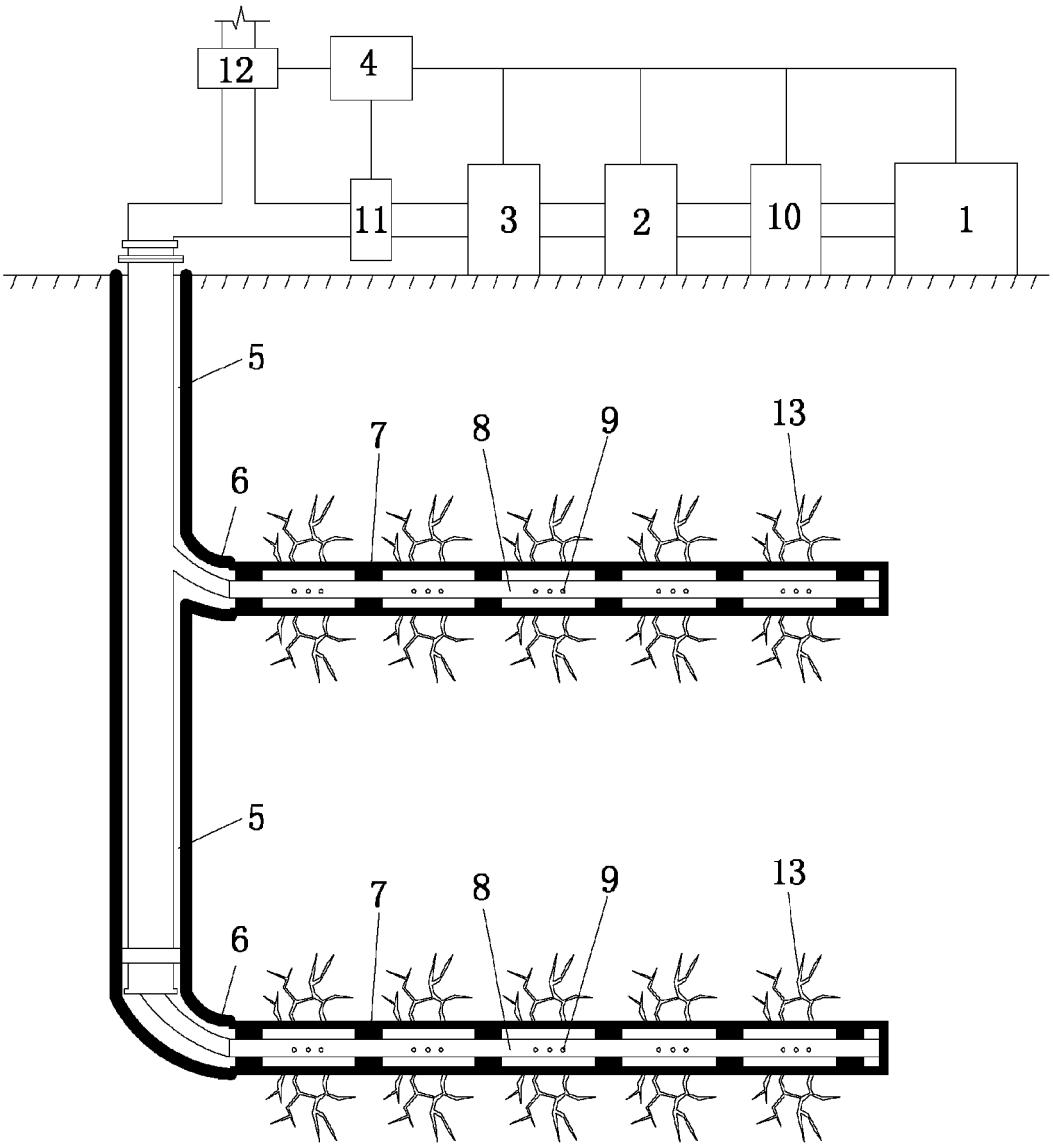
FIG. 8 is a structure diagram of fissures formed in a shale formation using a fourth system layout of FIG. 7.

C) Operations of step B) is repeated for 3 days under the control of the pressure controller 4. And fissures formed in the shale formation surrounding the horizontal well 6 are shown in FIG. 8.

Example 5

Figure 9:
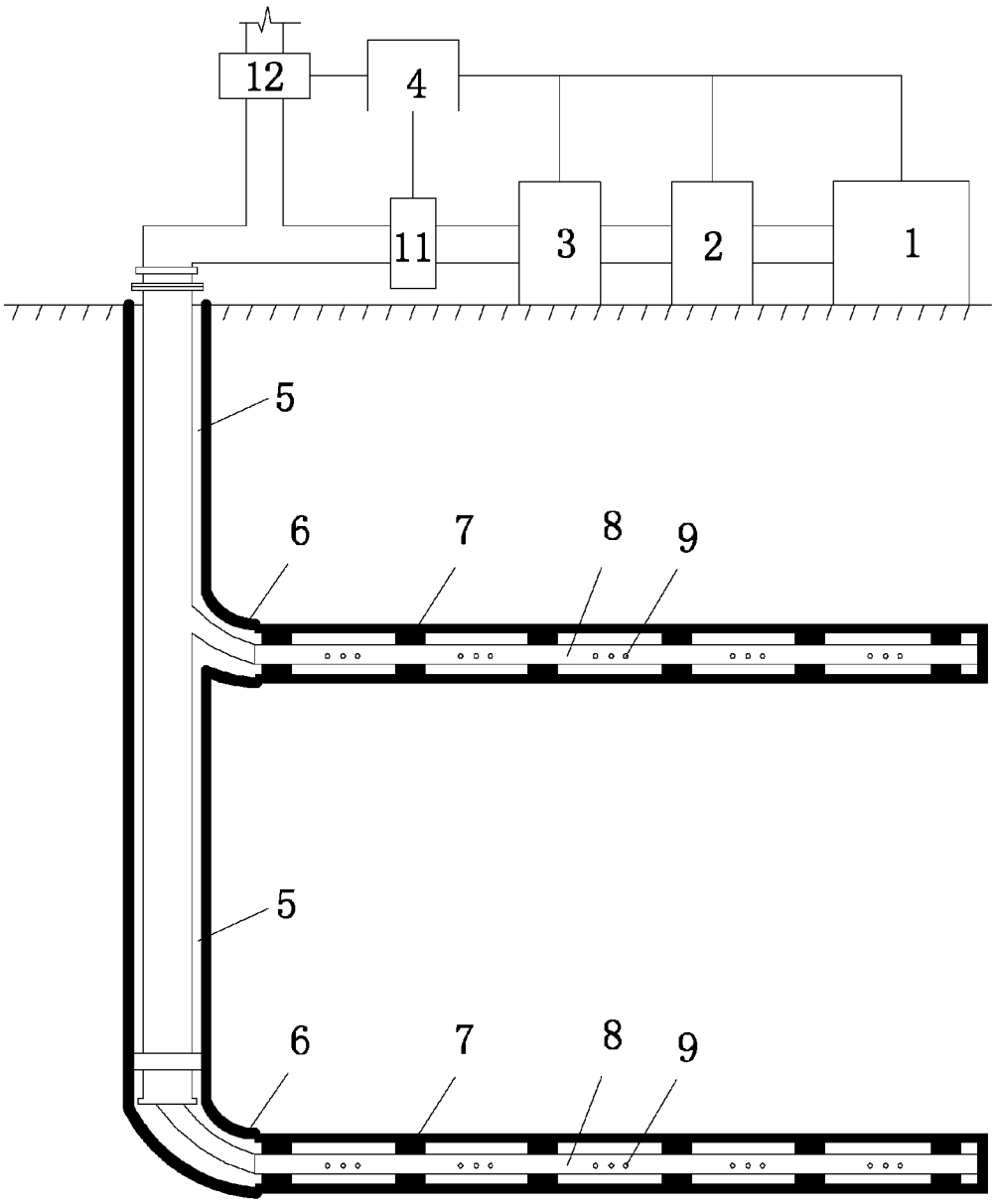
FIG. 9 is a fifth layout diagram of a pneumatic fracturing system for exploiting shale gas in accordance with one embodiment of the invention.

A pneumatic fracturing system is shown in FIG. 9, and a pneumatic fracturing method for exploiting shale gas using the system employs compressed carbon dioxide of two different pressures to alternately act on a shale formation. The method is conducted as follows:

A) A vertical well 5 and two horizontal wells 6 are drilled in the shale formation. The two horizontal wells 6 communicate with the vertical well 5 and are arranged at a certain interval on the same side of the vertical well 5. A gas transporting pipeline 8 having insulation property is installed in the vertical well 5 and the horizontal wells 6. An outer diameter of the gas transporting pipeline 8 is smaller than an inner diameter of the vertical well 5 and an inner diameter of each horizontal well 6. Ventholes 9 are arranged on a wall of the gas transporting pipeline 8 installed in each of the two horizontal well 6. An annular space forms between an inner surface of the horizontal well 6 and an outer surface of the gas transporting pipeline 8, and annular occluders 7 are arranged in the annular space at an interval of 40 m to form a plurality of annular gas chambers.

The pneumatic fracturing system for exploiting shale gas comprises: a compressor 1, a booster 2, a heater 3, and a pressure control system. The pressure control system comprises: a pressure controller 4, a first control valve 11, and a second control valve 12. The first control valve 11 is disposed on a gas inlet pipe of the gas transporting pipeline 8. The second control valve 12 is disposed on a gas outlet pipe of the gas transporting pipeline 8. A gas outlet of the compressor 1 communicates with a gas inlet of the booster 2 via a pipe fitting. A gas outlet of the booster 2 communicates with a gas inlet of the heater 3 via a pipe fitting. A gas outlet of the heater 3 communicates with a gas inlet of the first control valve 11 via a pipe fitting. The pressure controller 4 is connected to the compressor 1, the booster 2, the heater 3, the first control valve 11, and the second control valve 12 via data lines.

B) The pressure controller 4 is operated, and the compressor 1, the booster 2, and the heater 3 are started to enable the first control valve 11 to be in an open sate. The compressor 1 preliminarily compresses normal pressure carbon dioxide to reach a pressure of 1 megapascal; the booster 2 pressurizes the compressed carbon dioxide from the compressor 1 to reach a pressure of 25 megapascal; and the heater 3 heat the pressurized carbon dioxide to a temperature of 80° C. to yield the compressed carbon dioxide of a maximum pressure set in this example. The compressed carbon dioxide of the maximum pressure is injected into the gas transporting pipe 8 through the first control valve 11 and the maximum pressure is maintained for 1 hr. After the holding time, the first control valve 11 is closed and the second valve 12 is opened under the control of the pressure controller 4 to decrease the gas pressure in the gas transporting pipe 8 to 8 megapascal, which is the minimum pressure set in this example. Thus, the compressed carbon dioxide of 25 megapascal and the compressed carbon dioxide of 8 megapascal alternately fill each annular gas chamber and act on the shale formation.

Figure 10:
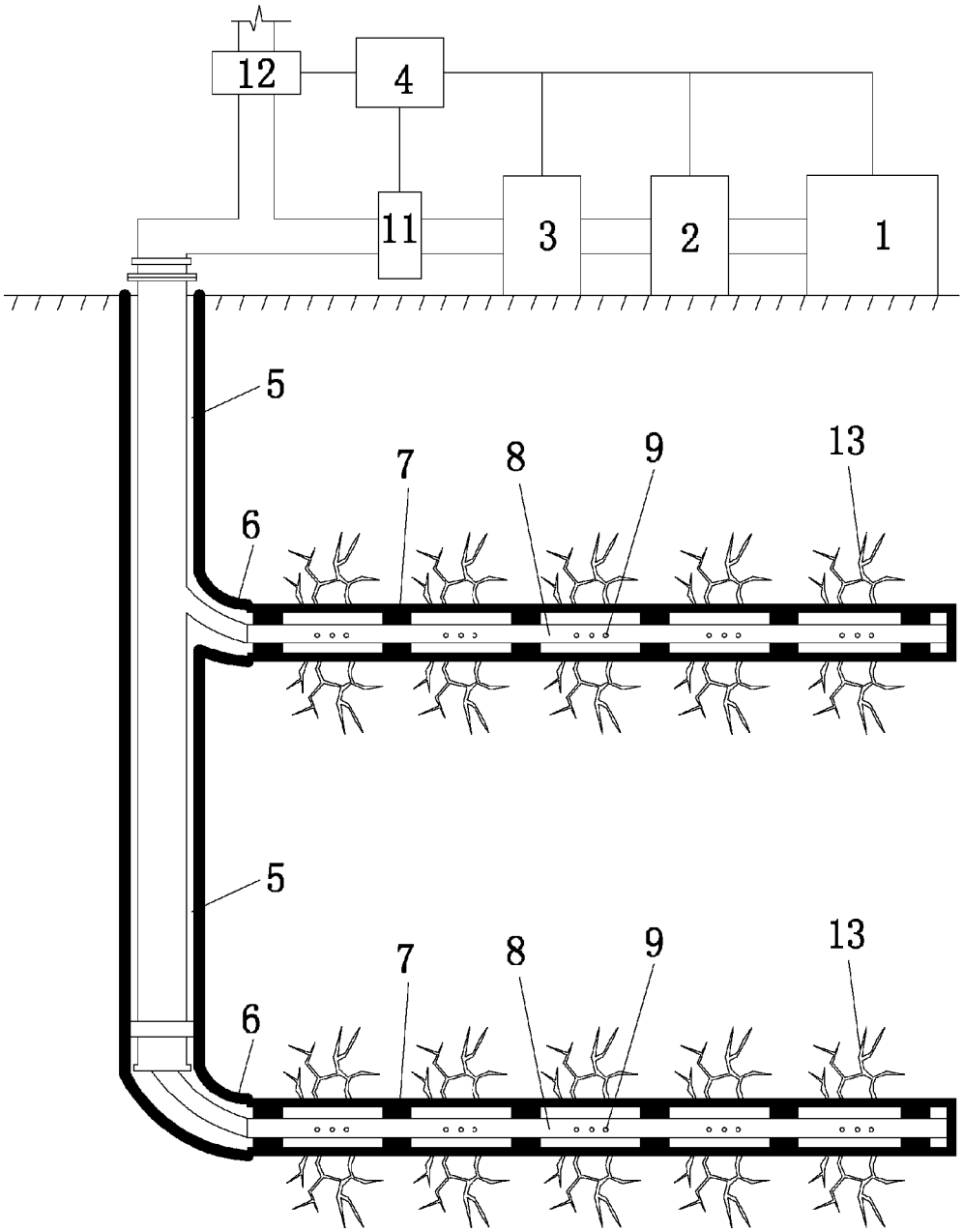
FIG. 10 is a structure diagram of fissures formed in a shale formation using a fifth system layout of FIG. 9.

C) Operations of step B) is repeated for 7 days under the control of the pressure controller 4. And fissures formed in the shale formation surrounding the horizontal wells 6 are shown in FIG. 10.

Example 6

Figure 11:
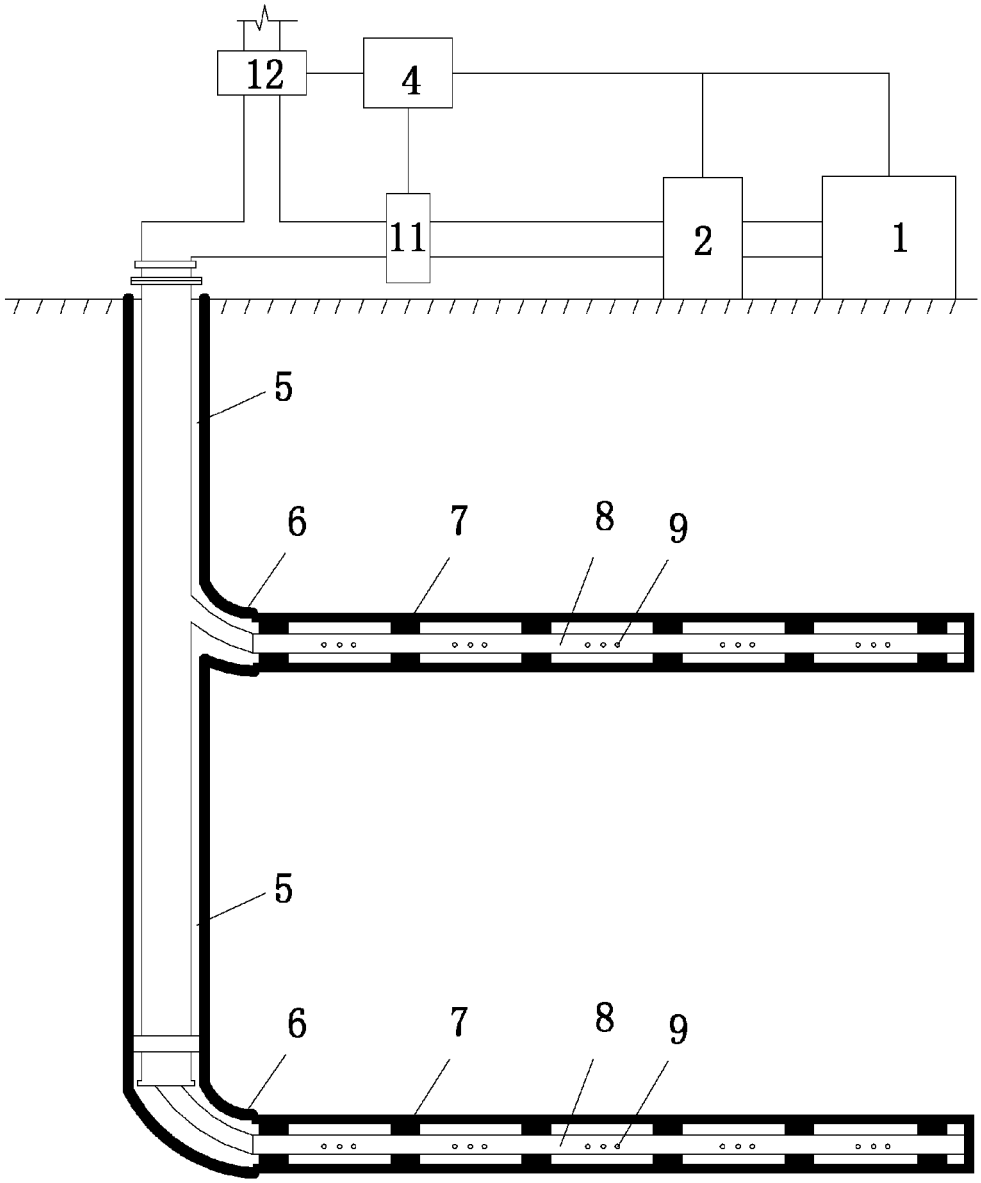
FIG. 11 is a sixth layout diagram of a pneumatic fracturing system for exploiting shale gas in accordance with one embodiment of the invention.

A pneumatic fracturing system is shown in FIG. 11, and a pneumatic fracturing method for exploiting shale gas using the system employs compressed air of two different pressures to alternately act on a shale formation. The method is conducted as follows:

A) A vertical well 5 and two horizontal wells 6 are drilled in the shale formation. The two horizontal wells 6 communicate with the vertical well 5 and are arranged at a certain interval on the same side of the vertical well 5. A gas transporting pipeline 8 having insulation property is installed in the vertical well 5 and the horizontal wells 6. An outer diameter of the gas transporting pipeline 8 is smaller than an inner diameter of the vertical well 5 and an inner diameter of each horizontal well 6. Ventholes 9 are arranged on a wall of the gas transporting pipeline 8 installed in each of the two horizontal well 6. An annular space forms between an inner surface of the horizontal well 6 and an outer surface of the gas transporting pipeline 8, and annular occluders 7 are arranged in the annular space at an interval of 40 m to form a plurality of annular gas chambers.

The pneumatic fracturing system for exploiting shale gas comprises: a compressor 1, a booster 2, and a pressure control system. The pressure control system comprises: a pressure controller 4, a first control valve 11, and a second control valve 12. The first control valve 11 is disposed on a gas inlet pipe of the gas transporting pipeline 8. The second control valve 12 is disposed on a gas outlet pipe of the gas transporting pipeline 8. A gas outlet of the compressor 1 communicates with a gas inlet of the booster 2 via a pipe fitting. A gas outlet of the booster 2 communicates with a gas inlet of the first control valve 11 via a pipe fitting. The pressure controller 4 is connected to the compressor 1, the booster 2, the first control valve 11, and the second control valve 12 via data lines.

B) The pressure controller 4 is operated, and the compressor 1 and the booster 2 are started to enable the first control valve 11 to be in an open sate. The compressor 1 preliminarily compresses normal pressure air to reach a pressure of 1 megapascal. The booster 2 further pressurizes the compressed air from the compressor 1 to form compressed air having a temperature of exceeding 150° C. and a pressure of 60 megapascal, the pressure of which reaches the maximum pressure set in this example. The compressed air of the maximum pressure is injected into the gas transporting pipe 8 through the first control valve 11 and the maximum pressure is maintained for 1 hr. After the holding time, the first control valve 11 is closed and the second valve 12 is opened under the control of the pressure controller 4 to decrease the air pressure in the gas transporting pipe 8 to 20 megapascal, which is the minimum pressure set in this example. Thus, the compressed air of 60 megapascal and the compressed air of 20 megapascal alternately fill each annular gas chamber and act on the shale formation.

Figure 12:
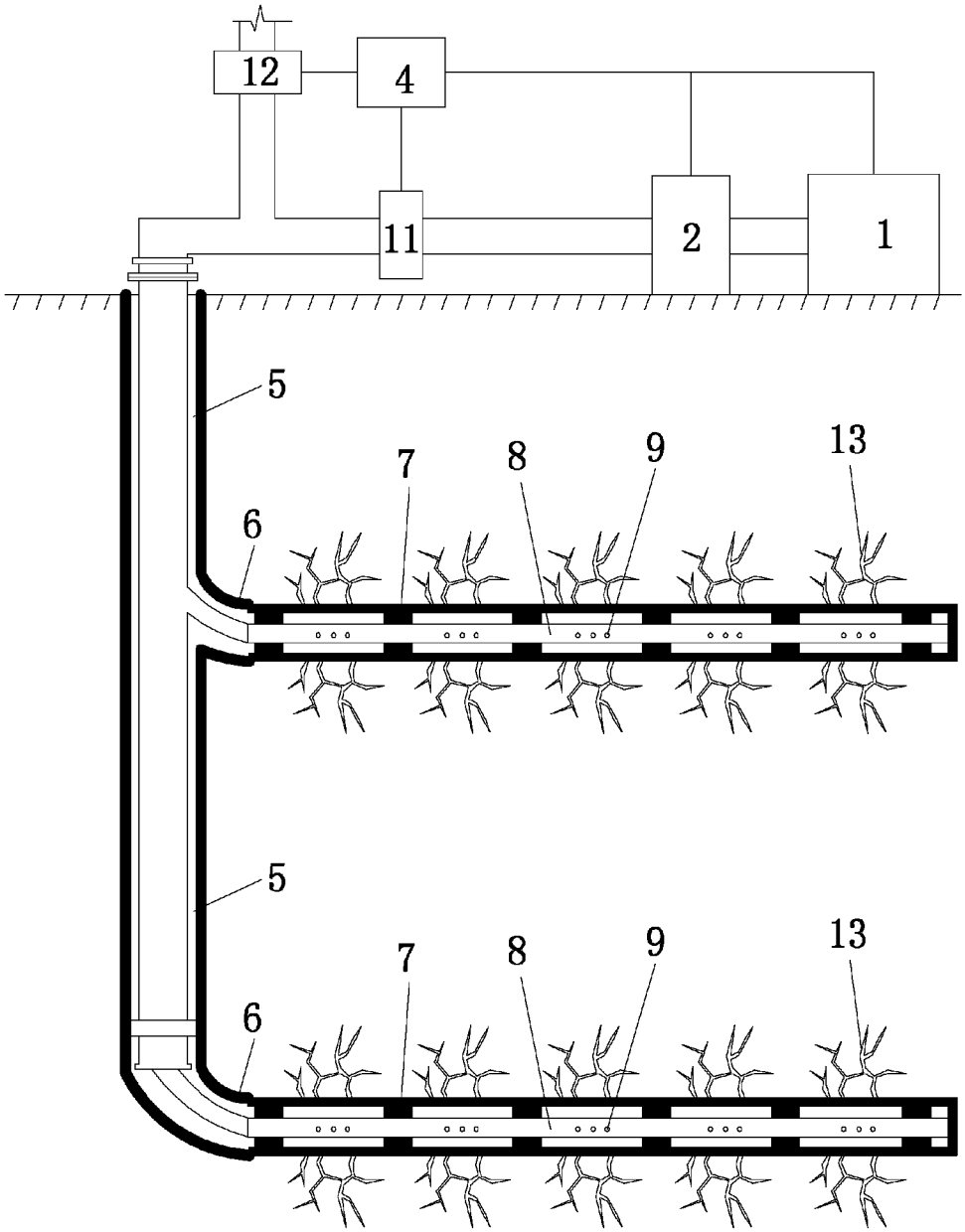
FIG. 12 is a structure diagram of fissures formed in a shale formation using a sixth system layout of FIG. 11.

C) Operations of step B) is repeated for 3 days under the control of the pressure controller 4. And fissures formed in the shale formation surrounding the horizontal wells 6 are shown in FIG. 12.

Example 7

Figure 13:
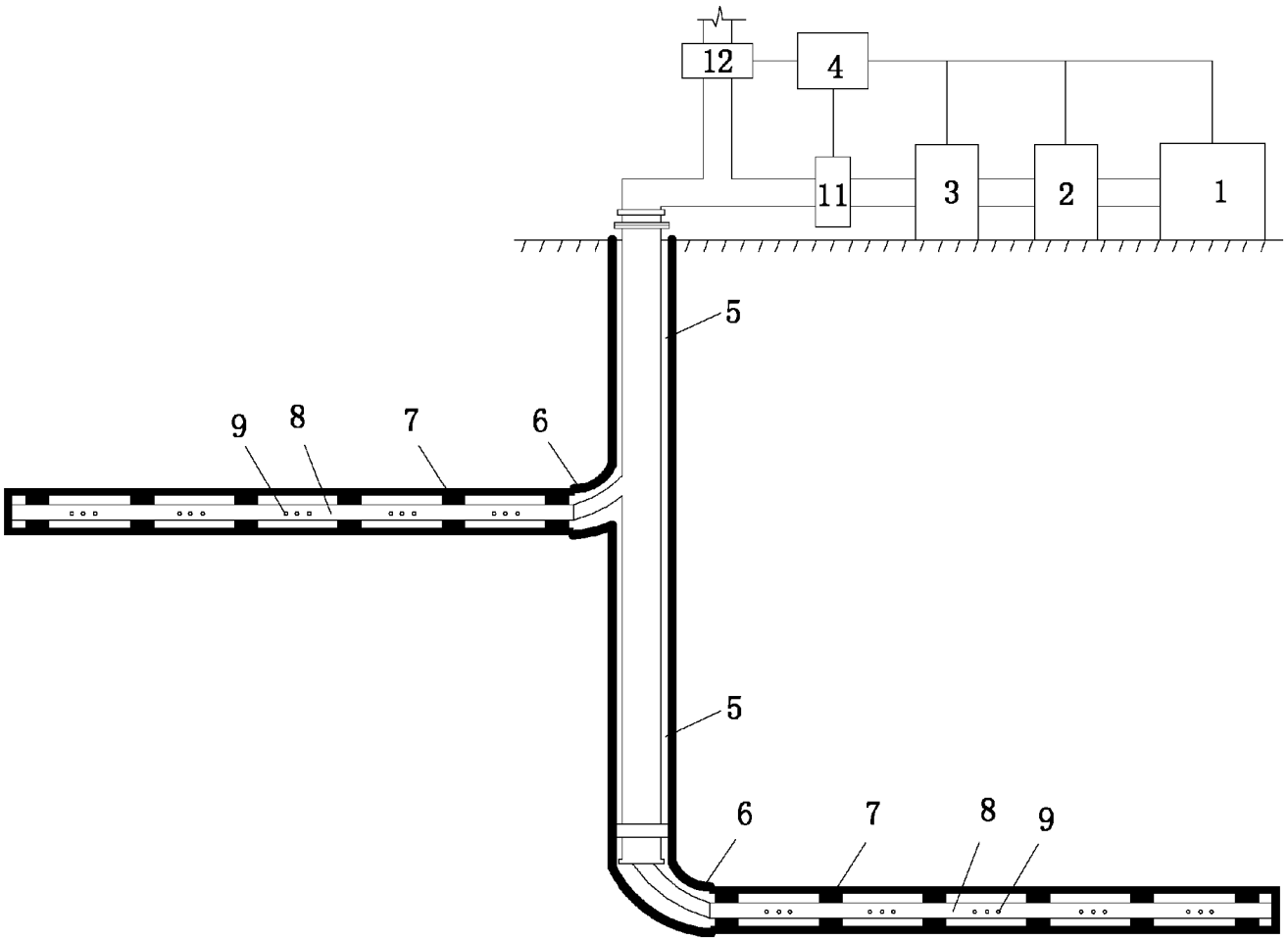
FIG. 13 is a seventh layout diagram of a pneumatic fracturing system for exploiting shale gas in accordance with one embodiment of the invention.

A pneumatic fracturing system is shown in FIG. 13, and a pneumatic fracturing method for exploiting shale gas using the system employs compressed carbon dioxide of two different pressures to alternately act on a shale formation. The method is conducted as follows:

A) A vertical well 5 and two horizontal wells 6 are drilled in the shale formation. The two horizontal wells 6 communicate with the vertical well 5 and are arranged at a certain interval on two sides of the vertical well 5. A gas transporting pipeline 8 having insulation property is installed in the vertical well 5 and the horizontal wells 6. An outer diameter of the gas transporting pipeline 8 is smaller than an inner diameter of the vertical well 5 and an inner diameter of each horizontal well 6. Ventholes 9 are arranged on a wall of the gas transporting pipeline 8 installed in each of the two horizontal well 6. An annular space forms between an inner surface of the horizontal well 6 and an outer surface of the gas transporting pipeline 8, and annular occluders 7 are arranged in the annular space at an interval of 50 m to form a plurality of annular gas chambers.

The pneumatic fracturing system for exploiting shale gas comprises: a compressor 1, a booster 2, a heater 3, and a pressure control system. The pressure control system comprises: a pressure controller 4, a first control valve 11, and a second control valve 12. The first control valve 11 is disposed on a gas inlet pipe of the gas transporting pipeline 8. The second control valve 12 is disposed on a gas outlet pipe of the gas transporting pipeline 8. A gas outlet of the compressor 1 communicates with a gas inlet of the booster 2 via a pipe fitting. A gas outlet of the booster 2 communicates with a gas inlet of the heater 3 via a pipe fitting. A gas outlet of the heater 3 communicates with a gas inlet of the first control valve 11 via a pipe fitting. The pressure controller 4 is connected to the compressor 1, the booster 2, the heater 3, the first control valve 11, and the second control valve 12 via data lines.

B) The pressure controller 4 is operated, and the compressor 1, the booster 2, and the heater 3 are started to enable the first control valve 11 to be in an open state. The compressor 1 preliminarily compresses normal pressure carbon dioxide to reach a pressure of 1 megapascal; the booster 2 pressurizes the compressed carbon dioxide from the compressor 1 to reach a pressure of 45 megapascal; and the heater 3 heat the pressurized carbon dioxide to a temperature of 80° C. to yield the compressed carbon dioxide of a maximum pressure set in this example. The compressed carbon dioxide of the maximum pressure is injected into the gas transporting pipe 8 through the first control valve 11 and the maximum pressure is maintained for 0.5 hr. After the holding time, the first control valve 11 is closed and the second valve 12 is opened under the control of the pressure controller 4 to decrease the gas pressure in the gas transporting pipe 8 to 12 megapascal, which is the minimum pressure set in this example. Thus, the compressed carbon dioxide of 45 megapascal and the compressed carbon dioxide of 12 megapascal alternately fill each annular gas chamber and act on the shale formation.

Figure 14:
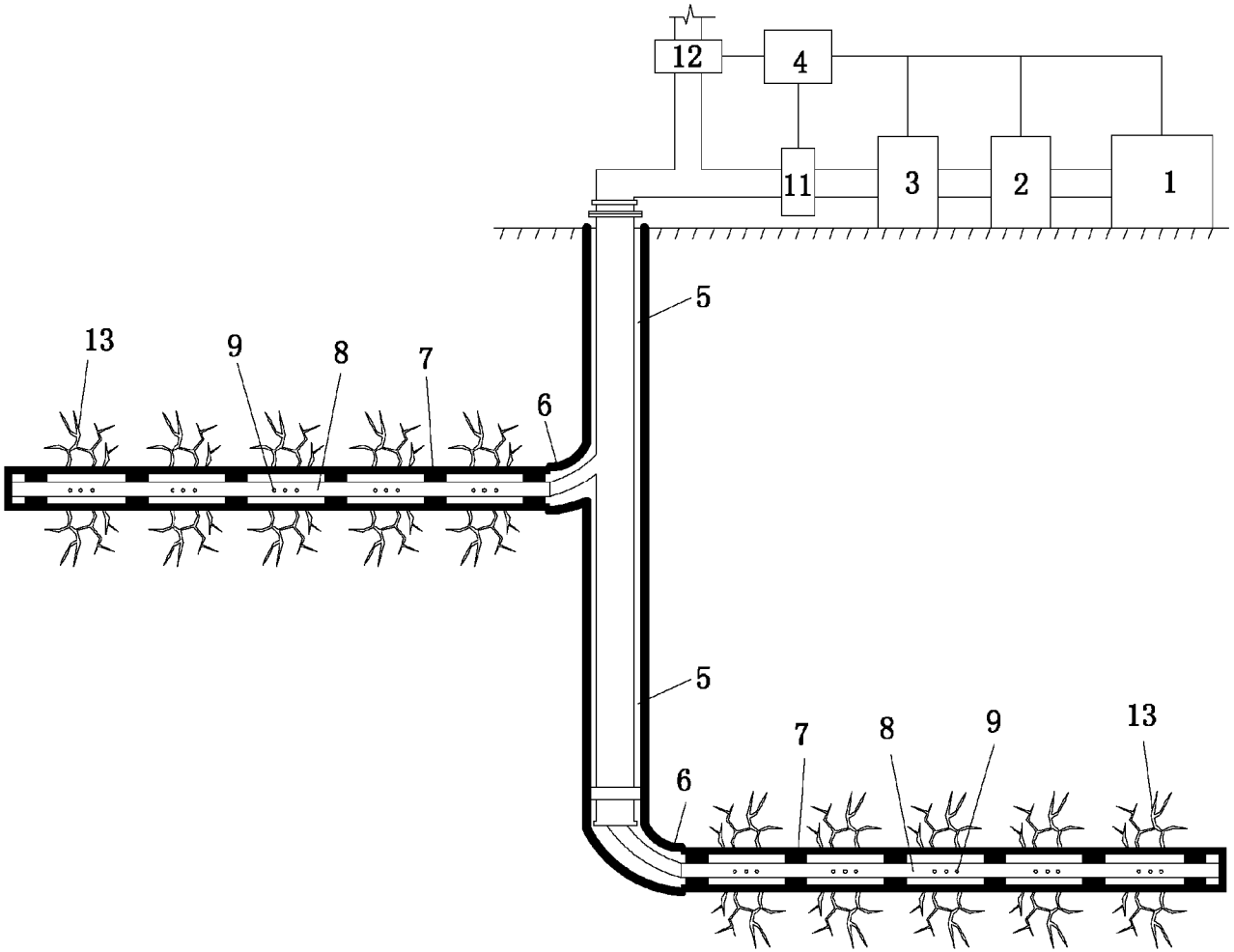
FIG. 14 is a structure diagram of fissures formed in a shale formation using a seventh system layout of FIG. 13.

C) Operations of step B) is repeated for 5 days under the control of the pressure controller 4. And fissures formed in the shale formation surrounding the horizontal wells 6 are shown in FIG. 14.

Example 8

Figure 15:
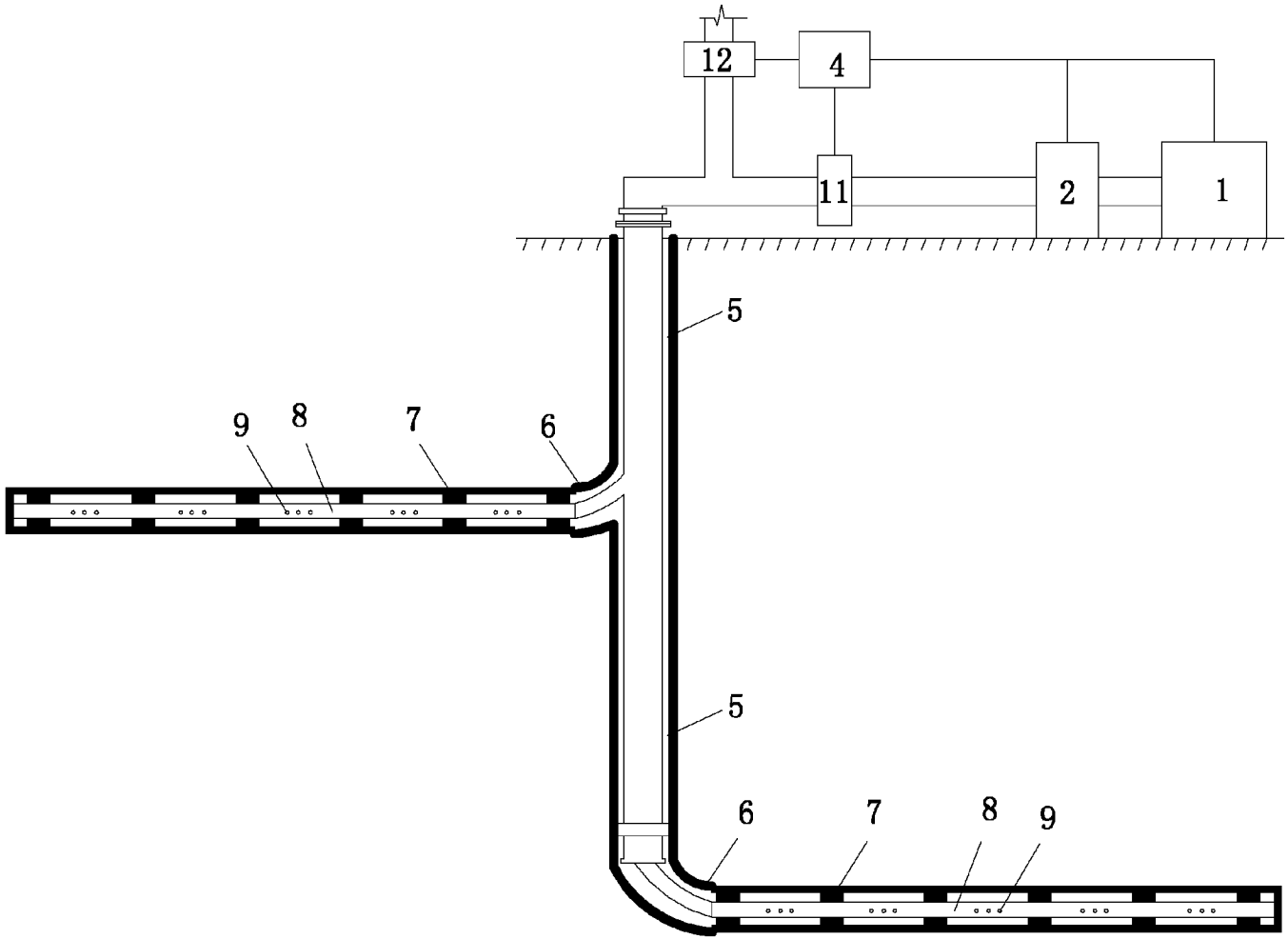
FIG. 15 is an eighth layout diagram of a pneumatic fracturing system for exploiting shale gas in accordance with one embodiment of the invention.

A pneumatic fracturing system is shown in FIG. 15, and a pneumatic fracturing method for exploiting shale gas using the system employs compressed air of two different pressures to alternately act on a shale formation. The method is conducted as follows:

A) A vertical well 5 and two horizontal wells 6 are drilled in the shale formation. The two horizontal wells 6 communicate with the vertical well 5 and are arranged at a certain interval on two sides of the vertical well 5. A gas transporting pipeline 8 having insulation property is installed in the vertical well 5 and the horizontal wells 6. An outer diameter of the gas transporting pipeline 8 is smaller than an inner diameter of the vertical well 5 and an inner diameter of each horizontal well 6. Ventholes 9 are arranged on a wall of the gas transporting pipeline 8 installed in each of the two horizontal well 6. An annular space forms between an inner surface of the horizontal well 6 and an outer surface of the gas transporting pipeline 8, and annular occluders 7 are arranged in the annular space at an interval of 50 m to form a plurality of annular gas chambers.

The pneumatic fracturing system for exploiting shale gas comprises: a compressor 1, a booster 2, and a pressure control system. The pressure control system comprises: a pressure controller 4, a first control valve 11, and a second control valve 12. The first control valve 11 is disposed on a gas inlet pipe of the gas transporting pipeline 8. The second control valve 12 is disposed on a gas outlet pipe of the gas transporting pipeline 8. A gas outlet of the compressor 1 communicates with a gas inlet of the booster 2 via a pipe fitting. A gas outlet of the booster 2 communicates with a gas inlet of the first control valve 11 via a pipe fitting. The pressure controller 4 is connected to the compressor 1, the booster 2, the first control valve 11, and the second control valve 12 via data lines.

B) The pressure controller 4 is operated, and the compressor 1 and the booster 2 are started to enable the first control valve 11 to be in an open sate. The compressor 1 preliminarily compresses normal pressure air to reach a pressure of 10 megapascal. The booster 2 further pressurizes the compressed air from the compressor 1 to form compressed air having a temperature of exceeding 150° C. and a pressure of 45 megapascal, the pressure of which reaches the maximum pressure set in this example. The compressed air of the maximum pressure is injected into the gas transporting pipe 8 through the first control valve 11 and the maximum pressure is maintained for 1 hr. After the holding time, the first control valve 11 is closed and the second valve 12 is opened under the control of the pressure controller 4 to decrease the air pressure in the gas transporting pipe 8 to 15 megapascal, which is the minimum pressure set in this example. Thus, the compressed air of 45 megapascal and the compressed air of 15 megapascal alternately fill each annular gas chamber and act on the shale formation.

Figure 16:
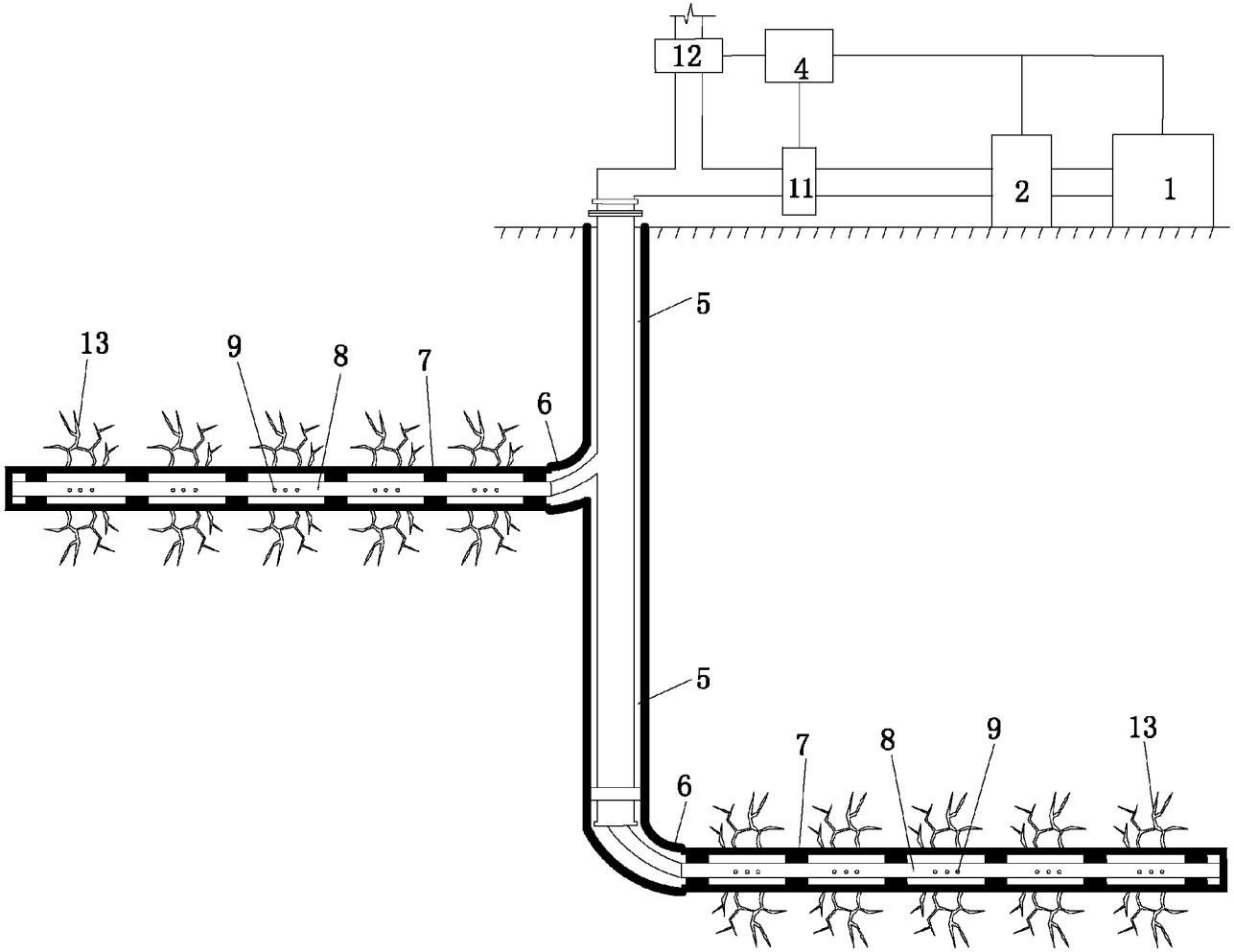
FIG. 16 is a structure diagram of fissures formed in a shale formation using a eighth system layout of FIG. 15.

C) Operations of step B) is repeated for 7 days under the control of the pressure controller 4. And fissures formed in the shale formation surrounding the horizontal wells 6 are shown in FIG. 16.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method of exploiting shale gas, the method comprising:

1) applying a compressed as for a first period of time at a first pressure to a shale formation;

2) applying the compressed gas for a second period of time at a second pressure to the shale formation; and 3) repeating steps 1) and 2) to produce fissures in the shale formation;

wherein:

the compressed gas is compressed air having a temperature of at least 150° C.;

a maximum pressure of the compressed gas is at least 45 megapascal; and a minimum pressure of the compressed gas is between ¼ and ⅓ of the maximum pressure.

2. The method of claim 1, wherein a water content of the compressed air is controlled between 10 and 50 volume %.

3. A method of exploiting shale gas, the method comprising:

A) drilling a vertical well and a horizontal well communicating with the vertical well in a shale formation, and installing a gas transporting pipeline having insulation property in the vertical well and the horizontal well;

wherein an outer diameter of the gas transporting pipeline is smaller than an inner diameter of the vertical well and an inner diameter of the horizontal well; ventholes are arranged on a wall of the gas transporting pipeline installed in the horizontal well; and an annular space forms between an inner surface of the horizontal well and an outer surface of the gas transporting pipeline, and annular occluders are arranged in the annular space at an interval of between 30 and 50 m to form a plurality of annular gas chambers;

B) injecting a compressed gas having a maximum pressure to the gas transporting pipeline, and maintaining the pressure for between 0.5 and 1 hr, and decreasing the pressure in the gas transporting pipeline to a minimum pressure after the holding time, whereby allowing the compressed gas of the maximum pressure and the compressed gas of the minimum pressure to alternately fill the annular gas chambers and act on the shale formation; and C) repeating step B) for several times to produce fissures in the shale formation;

wherein:

a temperature of the compressed gas is at least 80° C.;

a maximum pressure of the compressed gas is at least 25 megapascal, and a minimum pressure of the compressed gas is between ¼ and ⅓ of the maximum pressure.

4. The method of claim 3, wherein the compressed gas is compressed air, the temperature of the compressed gas is at least 150° C., and the maximum pressure is at least 45 megapascal.

5. The method of claim 3, wherein the compressed gas is compressed carbon dioxide, the temperature of the compressed gas is at least 80° C., and the maximum pressure is at least 25 megapascal.

6. A pneumatic fracturing system for exploiting shale gas, the system comprising:

a) a compressor;

b) a booster;

c) a pressure control system, the pressure control system comprising a pressure controller, a first control valve, and a second control valve;

d) a gas transporting pipeline, the gas transporting pipeline comprising a gas inlet pipe and a gas outlet pipe; and e) a dehumidifier;

wherein:

the first control valve is disposed on the gas inlet pipe of the gas transporting pipeline;

the second control valve is disposed on the gas outlet pipe of the gas transporting pipeline;

a gas inlet of the dehumidifier communicates with a gas outlet of the compressor via a pipe fitting;

a gas outlet of the dehumidifier communicates with a gas inlet of the booster via a pipe fitting;

a gas outlet of the booster communicates with a as inlet of the first control valve via a pipe fitting; and the pressure controller is connected to the compressor, the booster, the first control valve, the second control valve, and the dehumidifier via data lines for controlling formation of the compressed gas and holding of the pressure in the gas transporting pipeline.

7. The system of claim 6, wherein the pressure controller is a computer installed with a control software.

8. A pneumatic fracturing system for exploiting shale gas, the system comprising:

a) a compressor;

b) a booster;

c) a heater;

d) a pressure control system, the pressure control system comprising a pressure controller, a first control valve, and a second control valve;

e) a gas transporting pipeline, the gas transporting pipeline comprising a gas inlet pipe and a gas outlet pipe; and f) a dehumidifier;

wherein:

the first control valve is disposed on the gas inlet pipe of the gas transporting pipeline;

the second control valve is disposed on the gas outlet pipe of the gas transporting pipeline;

a gas inlet of the dehumidifier communicates with a gas outlet of the compressor via a pipe fitting;

a gas outlet of the dehumidifier communicates with a gas inlet of the booster via a pipe fitting;

a gas outlet of the booster communicates with a gas inlet of the heater via a pipe fitting;

a gas outlet of the heater communicates with a gas inlet of the first control valve via a pipe fitting; and the pressure controller is connected to the compressor, the booster, the heater, the first control valve, the second control valve, and the dehumidifier via data lines for controlling formation of the compressed gas and holding of the pressure in the gas transporting pipeline.

9. The system of claim 8, wherein the pressure controller is a computer installed with a control software.

* * * * *